United States Patent [19]

Iwata et al.

[11] Patent Number: 4,716,629

[45] Date of Patent: Jan. 5, 1988

[54] COMBINING CYLINDER OF A COMBER IN SPINNING MACHINERY

[75] Inventors: Kunio Iwata, Itami; Kenya Hagimoto, Amagasaki, both of Japan

[73] Assignee: Kanai Juyo Kogyo Co., Ltd., Hyogo, Japan

[21] Appl. No.: 765,955

[22] Filed: Aug. 15, 1985

[51] Int. Cl.[4] ..... D01G 15/84

[52] U.S. Cl. ..... 19/114; 132/11 R

[58] Field of Search ..... 19/114, 113, 97, 233; 132/11 R

[56] References Cited

U.S. PATENT DOCUMENTS 3,665,937 5/1972 Nakagawa et al. ..... 132/11 R

FOREIGN PATENT DOCUMENTS 572506 6/1924 France ..... 19/114

0094623 5/1984 Japan ..... 19/114

711646 7/1954 United Kingdom ..... 19/114

*Primary Examiner*—Louis K. Rimrodt

*Assistant Examiner*—J. L. Olds

*Attorney, Agent, or Firm*—Wenderoth, Lind & Ponack

[57] ABSTRACT

A combing cylinder of a comber in spinning machinery has a combing cylinder having grooves having substantially rectangular cross-sectional shapes at regular intervals, each of the grooves having a small groove, and a plurality of laminated needle plate members having concave recessed portions at a position corresponding to the position at which the small groove is provided. An anti-slip member is locked in a space formed by the concave recessed portions and the small groove. The laminated needle plate member is formed by laminating needle plates, each having a concave recessed portion at one side of a needle inserting part and a connecting member locking part in which a connecting member is fixed.

8 Claims, 8 Drawing Figures

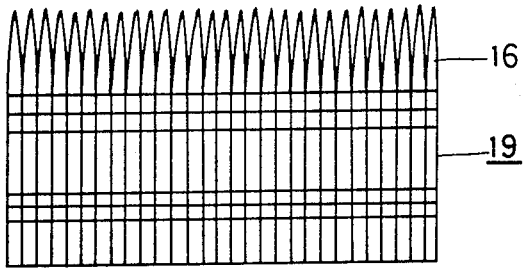
Fig. 4A
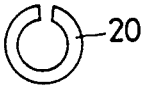
Fig. 4B
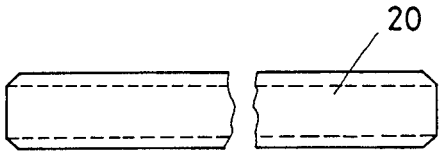

COMBINING CYLINDER OF A COMBER IN SPINNING MACHINERY

BACKGROUND OF THE INVENTION

1. Field of the Invention

This invention relates to a combing cylinder of a comber for use in a combing process in spinning.

2. Prior Art

As shown in FIG. 1, the conventional combing cylinder of comber comprises laminated needle plates which are formed by laminating a plurality of needle plates 5, each having a needle head 4 at its upper part and a dovetail groove 7 at one side of its fixing part and a triangular protrusion 9 at the other side thereof, and by inserting sash-like metal sheets 6 in the dovetail grooves 7, thus forming a needle row ribbon 8. A combing cylinder proper 1 has grooves 2 made therein in the radial direction of the cylinder and fitting grooves 3 made at one side wall of said grooves 2. Into each of these grooves a respective needle row ribbon 8 is inserted. The triangular projection 9 projecting from the side of the needle plate is fitted in the fitting groove 3.

In the above combing cylinder of a comber, the extent of interlocking of the groove 2 and the needle row ribbon 8 is very important, that is, no gap must be left between the two and yet the two must be interlocked easily. This is a contradictory relation. In the conventional combing cylinder of a comber, preference is given to ease of insertion. Therefore, when fiber is subjected to combing action by needle heads 4, the component force $F_1$ works in a direction that tends to pull the needle row ribbon 8 from the groove 2 and repetition of such during use over a long period of time results in acceleration of wear and transformation of the grooves 2 which enlarges the gap between the groove 2 and the needle row ribbon. This not only worsens dynamic accuracy and lowers combing action but also renders the combing cylinder proper 1 useless in a short time.

For making the gap between the needle row ribbon and the groove 2 as small as possible, precision forming the groove 2 must be accomplished and the groove 2 and the fitting groove 3 must be processed separately. This involves a high processing cost.

SUMMARY OF THE INVENTION

An object of the present invention is to solve the above-mentioned problems raised by the conventional combing cylinder of a comber, that is, to provide a combing cylinder of a comber in spinning machinery having laminated needle plate members that can easily be inserted into and removed from a groove made in a combing cylinder proper, wherein interlocking of the laminated needle plate members and the grooves are kept firm in spite of long use, no precision is required for forming the grooves, and the laminated needle plate members can easily be formed.

A combing cylinder of a comber in spinning machinery according to the present invention is constructed as mentioned below.

A laminated needle plate member is formed by laminating together a plurality of needle plates, each having a needle base part with a needle head at the upper portion thereof and a needle inserting part having a substantially rectangular shape with a concave recessed portion at one side thereof, and by locking a connecting member in a connecting member locking hole which is an I-shaped hole or a slit made in each needle plate.

Each laminated needle plate member is inserted into a respective groove having a substantially rectangular cross sectional shape and having a small groove at the position corresponding to a groove formed by the concave recessed portions of the needle plates, made in said combing cylinder proper. An anti-slip member is locked in a space formed by the concave recessed portion of the laminated needle plate member and the small groove in the combing cylinder proper.

The connecting member locking hole of the needle plate comprises a hole made in the needle base part and a slit open to the bottom surface of the needle inserting part or comprises only a long hole made in the needle plate.

The connecting member is a bar-shaped or a sash-like guide member made of metal, synthetic resin or the like which is inserted into the fixing part of the laminated needle plate member and is fixed by pouring an adhesive between this guide member and the locking hole or the connecting member or it is an elastic member made of shape-memory alloy, spring, foam resin or the like which is inserted or filled in the locking hole.

The anti-slip member is a round bar, a hollow body or a hollow body having a cut therein made of metal, such as iron, aluminium, etc., or synthetic resin.

BRIEF EXPLANATION OF THE DRAWINGS

The nature and advantages of the present invention will become more apparent from the following description made with reference to the accompanying drawings, in which:

FIG. 3 is a side view of a laminated needle plate member for use in the combing cylinder of a comber in spinning machinery according to the present invention;

FIG. 4A is a front view of an anti-slip member of the present invention and FIG. 4B is a side view of the anti-slip member shown in FIG. 4A;

DETAILED DESCRIPTION OF THE INVENTION

Embodiment 1

Figure 1:
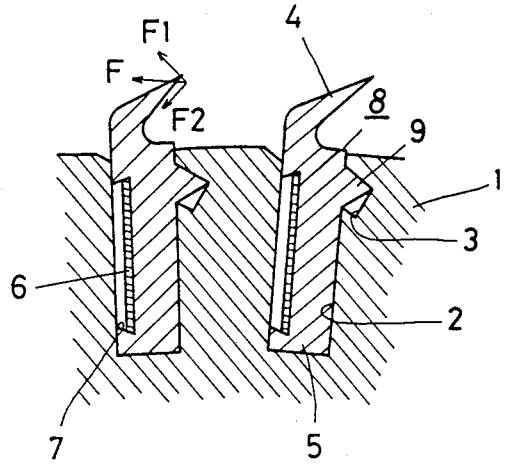
Fig. 1 PRIOR ART
FIG. 1 is a cross sectional view of a main part of the conventional combing cylinder of a comber.
Figure 2:
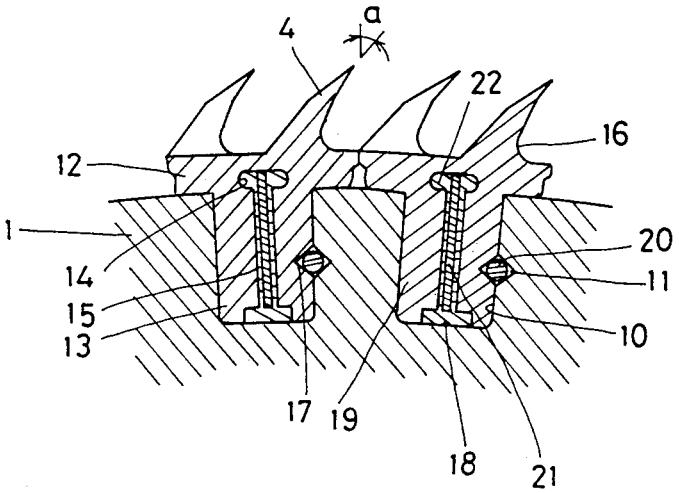
FIG. 2 is a cross sectional view of a main part of an embodiment of the combing cylinder of a comber in spinning machinery according to the present invention.

FIG. 2 is a cross sectional view of a main part of a combing cylinder of a comber in spinning machinery according to the present invention.

Figure 5:
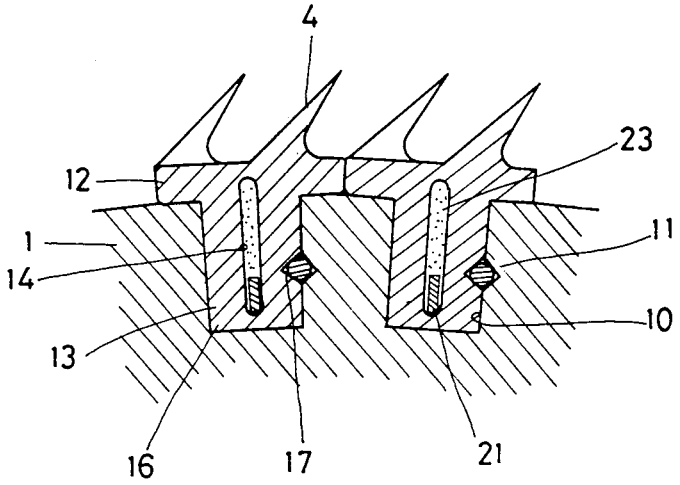
FIG. 5 is a cross sectional view of a main part of another embodiment of the present invention.
Figure 6:
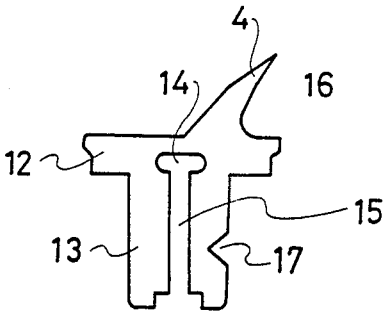
FIG. 6 is a front view of a needle plate of the embodiment shown in FIG. 2.
Figure 7:
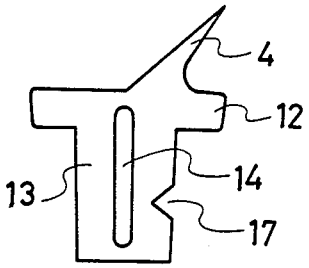
FIG. 7 is a front view of a needle plate of the embodiment shown in FIG. 5.

Needle plate member grooves 10 having substantially rectangular cross sectional shapes are made at equal intervals in the outer circumferential surface of the combing cylinder proper 1 in an axial direction. As shown in FIG. 5 a small groove 11 having a substantially triangular shape is made at one side of each groove 10. A needle plate 16 comprises a needle base part 12 with a needle head 4 having a working angle $\alpha$ in the rotational direction of the combing cylinder, a needle inserting part 13 having a substantially rectangular shape and a connecting member locking part in said needle inserting part. A hole 14 is made in the needle base plate 12 and a slit 15 which is open to and communicates with the hole 14 is made in the needle inserting part 13. The hole 14 and the slit 15 form substantially an "I" shape. A concave recessed part 17 having a substantially triangular shape cross sectional is provided at the position corresponding to the small groove 11 made in the combing cylinder proper.

The hole 14 can be made at a part of the needle inserting part 13 in such a fashion that it is open to and communicates with the slit 15 and can take the shape of an oval, rectangle, triangle or the like.

A plurality of needle plates 16 are laminated together in such a fashion that adjoining needle heads 4 in the axial direction of the combing cylinder are arranged in a zigzag fashion in the rotational direction of the combing cylinder. A connecting member 18 made of metal, synthetic resin or the like is fitted into and fixed in the connecting member locking hole composed of the holes 14 and slits 15 of needle plates and thus a laminated needle plate member 19 is formed. (FIG. 3)

The laminated needle plate member 19 is inserted into the groove 10 made in the combing cylinder proper from the axial direction or from the radial direction so that the groove in the laminated needle plate member formed by the recessed parts of the needle plates and the small groove 11 made at one side of the groove of the combing cylinder oppose each other.

An anti-slip member 20 is fitted in a space formed by the concave recessed part 17 and the small groove 11 of combing cylinder and thus a combing cylinder of comber in spinning machinery according to the present invention is composed.

As shown in FIG. 2, the connecting member 18 is formed by inserting a core piece 21 in the slit 15 and by pouring synthetic resin 22 onto the core piece 21. This formation ensures firm fixing of the laminated needle plate member 19 and ease in the fixing operation. The connecting member 18 can also be formed by thrusting a metal bar, a metal sheet, a sheet made of shape-memory alloy, a synthetic resin sheet or combination thereof, or by only pouring and filling up the connecting member locking hole with synthetic resin.

The anti-slip member 20, as shown in FIG. 2, is a round bar or a hollow member made of metal (iron, aluminium, for example), synthetic resin or the like, or is a hollow member with a cut at its circumference, as shown in FIG. 4.

Embodiment 2

FIG. 5 is a cross sectional view of a main part of another embodiment of a the combing cylinder of comber in spinning machinery according to the present invention. .

In this embodiment, a connecting member locking part comprises a lengthwise hole, a needle plate 16 comprises a needle base part 12 with a needle head 4 having a working angle $\alpha$ in the rotational direction of a combing cylinder, and a needle inserting part 13 has a substantially rectangular shape with a hole 14 having a substantially I-shape extending therethrough forming the connecting member locking part. A concave recessed portion 17 is made at a front surface of the needle inserting part 13 and at the position corresponding to the small groove 11 of the combing cylinder.

Similarly to the Embodiment 1, a plurality of needle plates 16 are laminated together in such a fashion that needle heads 4 are arranged in a zigzag manner and a connecting member is formed by a core piece 21 made of metal, synthetic resin or the like, and a foam resin 23 thrust through and locked in the connecting member locking holes formed by the holes 14 of needle plates. Thus, a needle laminated plate member is formed. (FIG. 5)

The above-mentioned foam resin 23 is fixed by filling the hole 14 with a foam resin material 14 and then foaming it by heating the core piece 21 or by heating the laminated needle plate member by a heating furnace.

The combing cylinder of a comber in spinning machinery according to the present invention is composed by inserting the laminated needle plate members in the grooves 10 made in the combing cylinder proper (similar to Embodiment 1) from the axial direction or from the radial direction, by opposing the concave groove of the laminated needle plate member 19 formed by the concave recessed parts of needle plates to the small grooves 11 of the combing cylinder proper and by fitting the anti-slip members 20 into a space formed by the groove and the small grooves 11.

In the above embodiments, the needle head arrangement on the combing cylinder of a comber in spinning machinery is in a zigzag fashion but it is possible to have a different needle head arrangements by changing needle plates, to have a finer density of needle heads by using needle plates with a plurality of needle heads (2–4 needle heads) and to make the needle head pitches of adjoining laminated needle plate members shift gradually from coarseness to fineness. Space between needle heads in the axial direction can easily be varied by changing the thickness of the needle plate or by interposing spacers, having a proper thickness and made of metal or synthetic resin, between the needle plates.

Since the combing cylinder of a comber in spinning machinery according to the present invention is composed as mentioned above, the laminated needle plate member is pressed against the back surface of the groove made in the combing cylinder proper due to the spring effect of the anti-slip member and therefore is fixed accurately, and is free from being pulled out in the radial direction in combing. Also, no precision is required in forming the grooves in the combing cylinder proper. The laminated needle plate member can be inserted easily from the radial direction, as well as the axial direction, and any clearance between the laminated needle plate member and the groove can be compensated for by the elasticity of the anti-slip member. Since the grooves and the small grooves in the combing cylinder proper are of such a shape that they are easy to cut and process, processing of them can be done without difficulty. The laminated needle plate member to be used in the present invention can be formed easily by inserting a connecting member into a core piece into a connecting member locking hole from the bottom part or from the side part of the needle plates and by pouring and filing it with an adhesive, synthetic resin, foaming resin or the like. Since the holes 14 act as a guide for punching needle plates and when laminating the needle plates, a plurality of needle plates can easily be laminated and accordingly laminated needle plates members can be formed easily.

What is claimed is:

1. A combing cylinder comprising:

a cylindrical body having a plurality of needle plate member grooves in the outer circumference thereof extending in an axial direction of said cylindrical body, and a respective small groove extending in said cylindrical body in said axial direction at a side of each of said needle plate member grooves and open thereto;

a laminated needle plate member in each of said plurality of needle plate member grooves, said laminated needle plate member comprising a plurality of needle plates, each of said plurality of needle plates having a base part and a needle head extending from said base part outward from said cylindrical body, a needle inserting part extending from said base part opposite said needle head into a respective needle plate member groove, said needle inserting part having a recess therein open to said small groove at the side of said respective needle plate member groove, and each of said plurality of needle plates having a hole having a substantially I-shaped cross-section extending therethrough in said axial direction;

a connecting member extending through each of said holes of said plurality of said needle plate members and secured to each of said plurality of said needle plate members for fixing each of said plurality of needle plate member relative to one another; and an anti-slip member extending in said axial direction in each said small groove and each recess of said plurality of needle plates open to said each small groove for attaching each of said needle plate members to said cylindrical body.

2. A combing cylinder as claimed in claim 1, wherein said connecting member comprises a metal core member extending through each of said holes of said plurality of needle plates of said needle plate member, and a laminating means for securing said core member to each of said plurality of needle plates.

3. A combing cylinder as claimed in claim 1, wherein said connecting member is a synthetic resin and an adhesive.

4. A combing cylinder as claimed in claim 1, wherein said connecting member is elastic and is fabricated from one of a group consisting of a shape-memory alloy, a spring, and a foam resin.

5. A needle plate member of a combing cylinder, said needle plate member comprising:

a plurality of needle plates, each of said needle plates having a base part and a needle head extending from said base part, a needle inserting part extending from said base part opposite said needle head, said needle inserting part having a recess extending along the outer periphery thereof, and each of said plurality of needle plates having a hole having a substantially I-shaped cross-section extending therethrough in a direction parallel to the direction in which said recess extends; and a connecting member extending through each of said holes of said plurality of needle plates of said needle plate member secured to each of said plurality of needle plates of said needle plate member for fixing each of said plurality of needle plates relative to one another.

6. A needle plate member as claimed in claim 4, wherein said connecting member comprises a metal core member extending through each of said holes of said plurality of needle plates of said needle plate member and a laminating means for securing said core member to each of said plurality of needle plates.

7. A needle plate member as claimed in claim 6, wherein said connecting member is a synthetic resin and an adhesive.

8. A needle plate member as claimed in claim 5, wherein said connecting member is elastic and is fabricated from one of a group consisting of a shape-memory alloy, a spring, and a foam resin.

* * * * *